United States Patent [19]

Perna

[11] 4,197,338

[45] Apr. 8, 1980

[54] DRY WALL-BOARD SURFACE FINISHING

[76] Inventor: Anthony Perna, 118-01 101st Ave., Richmond Hill, N.Y. 11419

[21] Appl. No.: 953,695

[22] Filed: Oct. 20, 1978

Related U.S. Application Data

[63] Continuation-in-part of Ser. No. 861,864, Dec. 19, 1977, abandoned.

[51] Int. Cl.[2] ..... B05D 1/28; B05D 3/00; B05D 5/00

[52] U.S. Cl. ..... 427/278; 15/230.11; 15/244 A; 427/428; 427/429

[58] Field of Search ..... 15/244 A, 230.11; 427/278, 428, 429

[56] References Cited

U.S. PATENT DOCUMENTS

| | | | |
|---|---|---|---|
| 1,741,698 | 12/1929 | Hampson | 427/278 |
| 3,274,637 | 9/1966 | Schulze | 15/522 |
| 3,516,851 | 6/1970 | Kaila | 427/428 |
| 3,878,581 | 4/1975 | Perna | 15/235.7 |
| 3,897,577 | 7/1975 | Hymes | 427/428 X |

*Primary Examiner*—Michael R. Lusignan
*Attorney, Agent, or Firm*—Alexander Mencher

[57] ABSTRACT

In the finishing of dry wall-board surfaces at joints and outside and inside corners by applying joint compounds, by taping thereover and by applying wipe-off tools for removal of excess compound applied and feathering of the tape edges either simultaneously or otherwise, the improvement which comprises using a cellular or cellulosic sponge roller having an operative peripheral sleeve circular in profile and adapted to pick up and distribute said compound in the application thereof.

3 Claims, 8 Drawing Figures

DRY WALL-BOARD SURFACE FINISHING

BACKGROUND OF INVENTION

This application is a continuation-in-part of my copending application U.S. Ser. No. 861,864 filed Dec. 19, 1977, abandoned, under title of Dual Functioning Applicator and Texturing Roller. The invention relates generally to the field of applicator tools for the finishing of dry wall-board surfaces. More specifically, the invention relates to the utilization of a single roller tool having porous qualities for pick-up of said materials and suction qualities for transfer to wall corner areas preliminary to application as of taping and finishing tools. Such a roller is easy to use either by a layman or a professional operator since no prior training or practice is required. More specifically, the invention relates to use of an instrument for applying joint compounds, spackles and filling products to seams and corners in conjunction with taping and use of finishing dry-wall tools such as tools covered in U.S. Pat. No. 3,878,581 issued to me Apr. 22, 1975, said patent to be considered as incorporated herein by reference. Heretofore, such products including cements had to be picked up from the container or can as by a scraper, then deposited onto a hawk, then using a trowel or spackling knife for transfer from the hawk and then spreading the same over the area to be finished, operations difficult to handle and messy if undertaken by the non-professional. Such a series of steps as used by the professional, by means of the invention, has been eliminated by utilization of a novel applicator in the form of a roller comprised of a porous and resilient sponge material preferably of cellulosic material or equivalent plastic having suction powers for clean material pickup and roller-spreading functions.

Utilization of such an applicator by rolling on such compounds to apply and spread the same to the areas involved preliminary to tape application and subsequent operations with appropriate finishing and/or wipe-off tools as set forth in above patent results in a professional job capable of being done by the layman or handy person. Moreover, when used by the professional, much time is saved.

An important feature of using the type of sponge mentioned is that the nature of the material thereof lends itself to being cut to necessary shapes needed to cover all joints such as inside corners, outside corners, flat and convex areas as shown in FIGS. 1–4. Furthermore, said applicator may be used as an additional function for texturing as stated in aforementioned copending application for patent Ser. No. 861,864.

The roller element of the tool, as stated, is formed of presently available synthetic cellular cellulosic sponge stock capable of being cut in various sizes and shapes when in dry condition and capable of having surface yieldability with substantial retention of shape when in wet condition. One type of sponge described is sold by Dupont.

Prior art available and found has utilized rollers for paint transfer, combined feeding and transfer rollers and other applicators formed of felt, cloth, resinous sponge materials and other types of fabric, but no specific sponge rollers have been found for use in the finishing of dry wall-board corners and joints.

The following U.S. patents appear to be relevant:

U.S. Pat. No. Du Brau 798,888, Sept. 5, 1905

U.S. Pat No. Van Clief, Jr. 2,722,030, Nov. 1, 1955

U.S. Pat. No. Ames 2,824,326, Feb. 25, 1958

U.S. Pat. No. Schultze 3,274,637, Sept. 27, 1966

U.S. Pat. No. Lewis 3,431,616, Mar. 11, 1969

SUMMARY OF THE INVENTION

A main object of the invention resides in the use of means of picking up and spreading heavy surfacing materials to walls such as wall boards for dry-wall finishing by a specific type of applicator.

The specific means is predicated on the utilization of a sponge roller cut and shaped from a block of synthetic and porous or cellular cellulosic sponge having a body capable of cutting and shaping when dry and clean, capable of being coated with a heavy or viscous type of cementitious or similar material when dipped therein, capable of transferring said coated material onto surfaces as mentioned when swept thereacross.

The type of sponge roller described has surface yieldability while retaining substantial cylindrical shape to afford suctional function, has resiliency for maintenance of shape during exercise of said function against the substantial hardness of the inner regions of the sponge roller serving as a hard core to sustain the weight of the heavy surfacing material and has capacity for being cleaned by cleaning compounds including opganic solvents for reuseability.

BRIEF DESCRIPTION OF DRAWINGS

FIG. 2 is a front view in elevation of another roller type of sponge applicator shaped for operation in corners and the like;

DESCRIPTION OF EMBODIMENTS OF THE INVENTION

Figure 1:
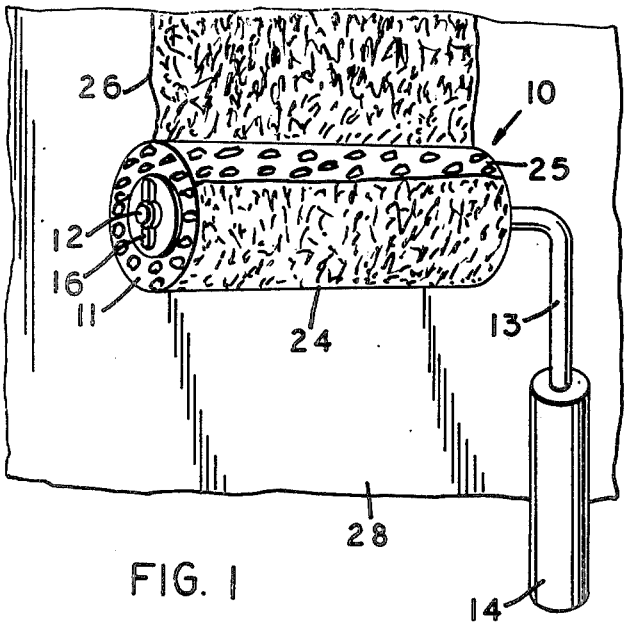
FIG. 1 is a view in perspective showing a roller type of sponge applicator utilizing the synthetic cellular type of cellulosic sponge described in the process of transferring a coating of surface material to walls and joints of dry wall-board surfaces, said sponge body being of cylindrical shape.
Figure 4:
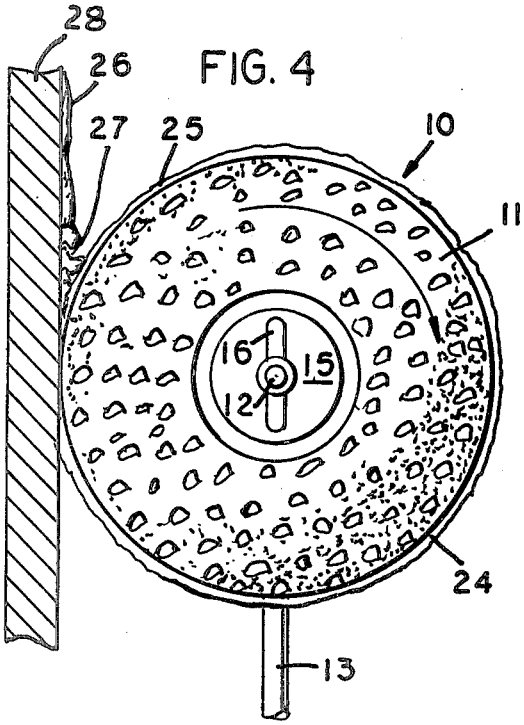
FIG. 4 is an enlarged end view in elevation of the applicator of FIG. 1 in the process of transfer of coating material to a wall joint or continuous surface.
Figure 3:
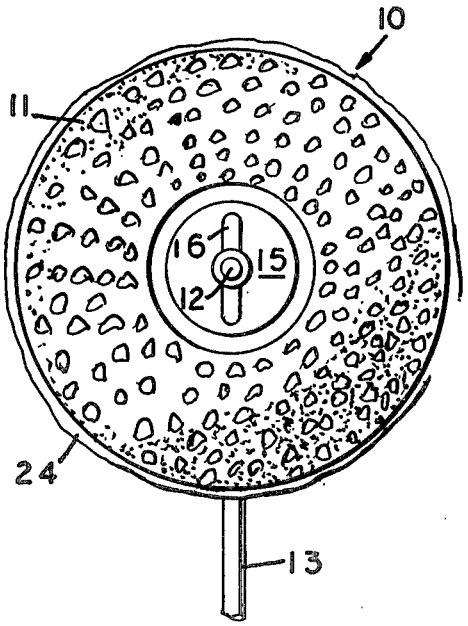
FIG. 3 is an enlarged end view in elevation of a cylindrical type of sponge applicator showing the surface thereof coated with a surfacing material and adapted to be transferred to a surface.

In accordance with the invention and the preferred forms shown, the sponge applicator of FIGS. 1, 3 and 4 generally indicated by numeral 10 and wherein the roller sponge element is cylindrical in shape for flat walls or surfaces and preferably of the dry-wall type is comprised of a roller sponge element 11 axially bored to receive a bearing rod 12 for free rotation. Bearing rod 12 is suitably offset as at 13 to serve as a mounting for the handle 14. The end walls of cylindrical sponge roller of element 11 are suitably provided with conventional bearings for the end areas of bearing rod or axle 12, the latter having stop members as cotter pins or other similar functioning elements to limit longitudinal displacement of the axle 12, at least one of the stop members preferably being removeable for freeing the roller 11 for cleaning or substitution of other sponge members.

To the extent shown, the end walls of sponge roller or element 11 are concentrically countersunk for introduction as by frictional engagement of peripherally flanged and centrally apertured bearing plates 15 against which stop elements 16 bear. Stop elements 16 are applied to axle 12 adjacent the free end thereof and adjacent the opposite inner end.

Figure 2:
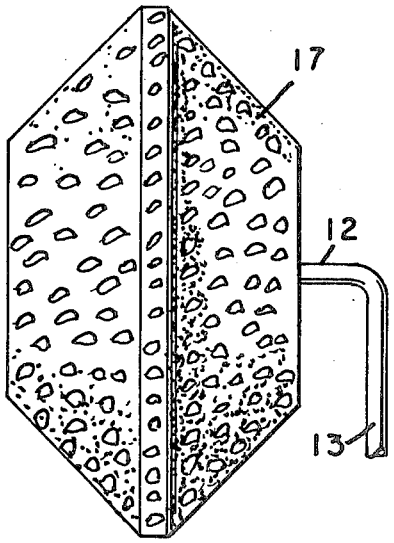
Figure 5:
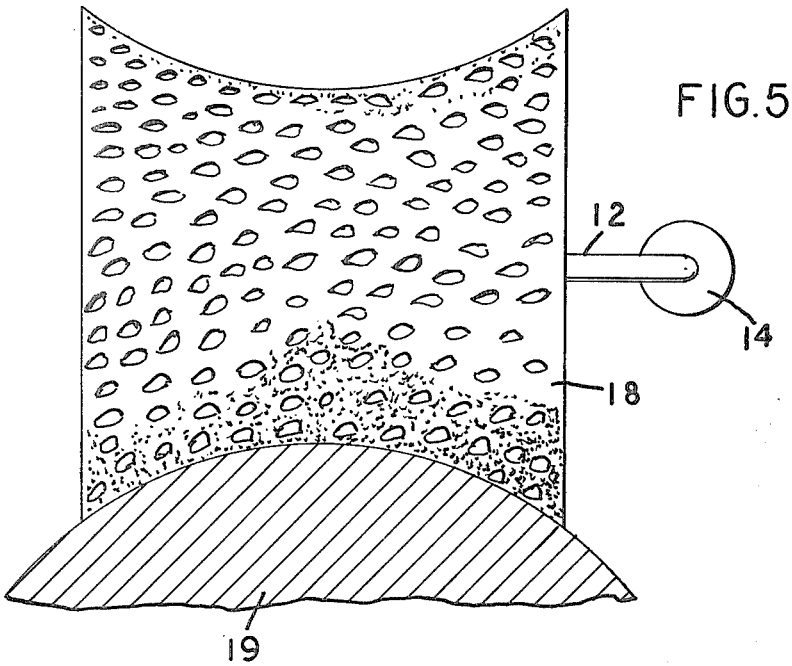
FIGS. 5, 6 and 7 are plan views of different shapes of roller type of sponge applicators applied to curved surfaces as shown in section and representing respectively a curved or convex surface, an ellipsoidal concave surface, and a concave surface of circular radius.
Figure 6:
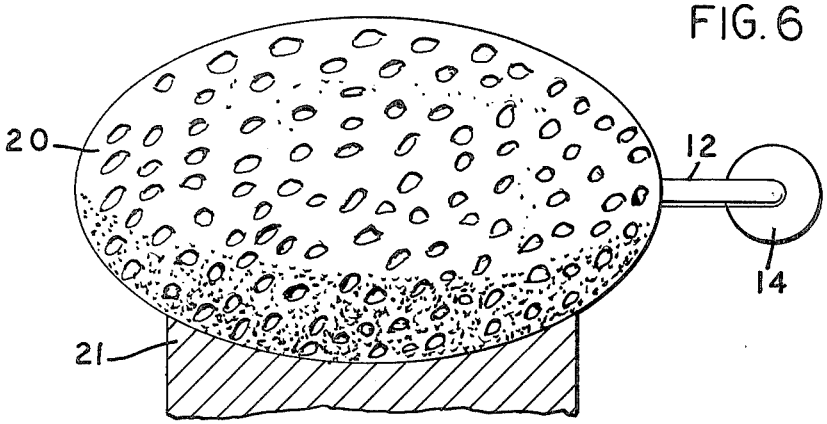
Figure 7:
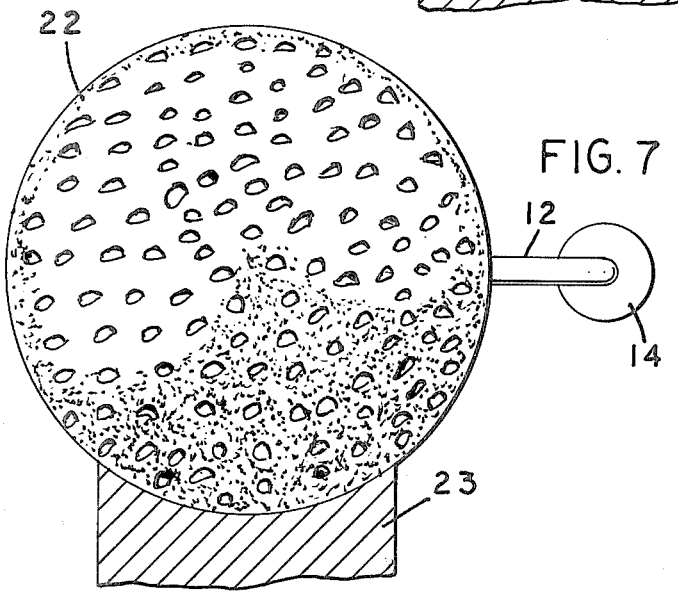

In FIG. 2 a sponge roller shaped for dry-wall corner operations is indicated by numeral 17 while FIG. 5 shows a sponge roller 18 shaped for convex surfaces 19. FIG. 6 shows a sponge roller 20 shaped for an ellipsoidal concave surface 21 and FIG. 7 shows 22, a sponge roller shaped for a spherical type of concave surface 23. It is understood that other shapes are available and that differently shaped sponges may be mounted on the same axle 12 for multishaped surfaces, joints and corners.

Each of the sponge rollers 11, 17, 18, 20 and 22 are capable of having adhered to the peripheries thereof by roller dipping and manipulating in the material container a transferable layer of heavy or cementitious material 24 as for dry-wall finishing and including joint cement (oil or water based). The surfaces of the sponge rollers 11, 17, 18, 20 and 22 may be fed as by conventional dipping in reservoirs or containers and manipulated in the heavy material by various directional pressures to induce suctional function and consequently for surface and pore saturation.

Figure 8:
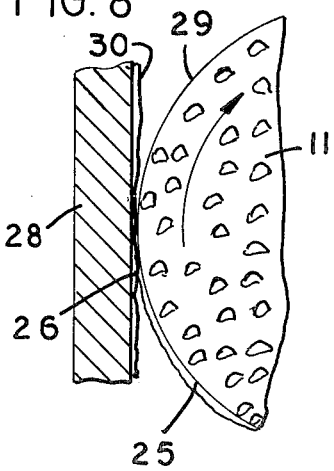
FIG. 8 is a partial and enlarged view in end elevation showing the roller type of sponge applicator of FIG. 1 in the process of performing an incidental texturing function on a wall shown in section if so desired.

Material 24 is transferable to surface from the sponge rollers by conventional roller operation as by the ordinary paint roller as in the direction indicated by arrows shown in FIGS. 4 and 8. As best shown in FIGS. 1, 4 and 8, material 24 is transferred to wall 28 as indicated by numeral 26 by a suctional effect as indicated at 27 leaving the freed roller area with a thin film of material as at 25. After full transfer of the material 24 from the roller periphery, the roller may be further swept along the wall material 26 with variable hand pressure and in selective directions to effectuate an even distribution contemporaneously with appropriate finishing tools as mentioned.

As seen in FIG. 8, the periphery 29 of sponge roller element 11 is even freed of the film 25 when further pressed against the wall 28 for distribution or formation 30, such formation being effected by the suctional power of the cellulosic and cellular sponge material. Of course, it is understood that cellulosic sponge is capable of cleaning and is otherwise inert to organic solvents, but it is understood that other cellular plastics similarly inert may be utilized.

Thus, the specific type of applicator as described is made for easy and efficient use for dry wallboard finishing including joints and corners thereof and makes possible the use of rollers for feeding cementitious or like material from material reservoirs and then as in a paint roller applying same to the area required to be worked. After the material has been so spread with respect to filling of joints and corners and spread over adjacent areas, suitable taping is applied thereover for adherence thereto. Finishing tools for smoothing, wiping, wiping off excess material and feathering the tape edges are then applied. However, part of the invention herein relates to a system using a combination tool for performing the functions of simultaneous smoothing of the tape after adherence, wiping off excess material and feathering of the tape edges, or in other words by single sweep operations. Such a combination tool or tools is described in my aforesaid U.S. Pat. No. 3,878,581, Xerox copy of which is attached hereto and wherein the drawings and specififation thereof are to be considered as part of the instant application.

Following drying after the steps of the system have been exercised, another application of the material may be applied by the roller over the tape and adjacent areas if desired and the finishing tool or tools further applied. Time for drying is usually overnight, but depending on the material being used.

It is distinctly understood that minor changes and variations in the novel utilization of the roller in the process of finishing dry wall-board surfaces and in the various steps of the novel system described may all be resorted to without departing from the spirit of the invention and the scope of the appended claims.

I claim:

1. In the process of finishing dry wall-board surfaces at joints and outside and inside corners, the improvement which comprises in combination, the step of picking up by hand operation a joint compound from a source of supply by a roller having a peripheral surface of sponge, the step of applying and manipulating by hand the said joint compound to said joints, corners and at adjacent areas thereof by said roller, the step of applying by hand taping over said joints and corners having said applied joint compound thereover, and the step of applying finishing tool means by hand for smoothing, wiping off excess compound and feathering of the taped edges.

2. In the process of finishing dry wall-board surfaces at joints and outside and inside corners as set forth in claim 1 wherein said finishing tool means comprises a hand manipulable tool for simultaneous smoothing, wiping off excess compound and feathering of the taped edges.

3. In the process of finishing dry wall-board surfaces at joints and outside and inside corners as set forth in claim 1 wherein said peripheral surface of sponge is circular in profile and is comprised of cellulosic material.

* * * * *